US006478498B1

(12) United States Patent
Miyasaka et al.

(10) Patent No.: US 6,478,498 B1
(45) Date of Patent: Nov. 12, 2002

(54) BALL FOR BALL-POINT PEN AND BALL-POINT PEN

(76) Inventors: Yoshito Miyasaka, c/o Suwanetsukogyo Co., Ltd., 4750-11, Nakasu, Suwa-shi, Nagano-ken, 392-0015 (JP); Hitoshi Karasawa, c/o Suwanetsukogyo Co., Ltd., 4750-11, Nakasu, Suwa-shi, Nagano-ken, 392-0015 (JP)

( * ) Notice: Subject to any disclaimer, the term of this patent is extended or adjusted under 35 U.S.C. 154(b) by 0 days.

(21) Appl. No.: 09/980,905

(22) PCT Filed: Jun. 2, 2000

(86) PCT No.: PCT/JP00/03600

§ 371 (c)(1),
(2), (4) Date: Dec. 3, 2001

(87) PCT Pub. No.: WO00/74951

PCT Pub. Date: Dec. 14, 2000

(30) Foreign Application Priority Data

Jun. 4, 1999 (JP) ..... 11-157577

(51) Int. Cl.[7] ..... B43K 7/10
(52) U.S. Cl. ..... 401/215; 401/209
(58) Field of Search ..... 401/215, 209, 401/208

(56) References Cited

U.S. PATENT DOCUMENTS 3,502,418 A * 3/1970 Payne ..... 401/215
4,150,905 A * 4/1979 Kaplan et al. ..... 401/215
4,634,306 A * 1/1987 Dzuik ..... 401/215
6,332,728 B1 * 12/2001 Ito et al. ..... 401/215

* cited by examiner

*Primary Examiner*—David J. Walczak
*Assistant Examiner*—Huyen Le
(74) *Attorney, Agent, or Firm*—Flynn, Thiel, Boutell & Tanis, P.C.

(57) ABSTRACT

To provide a ball for a ball-point pen and to provide a ball-point pen with the use of it which are superior in abrasion resistance and lubricating ability and can be manufactured easily.

A ball 2 for a ball-point pen is made of a material of stainless steel whose surface is formed with a nitrosulphurized layer, or a ball 2 for a ball-point pen is made of a material of aluminum chrome molybdenum steel whose surface is formed with a nitrosulphurized layer. A ball-point pen utilizing such a ball has superior writing qualities.

9 Claims, 2 Drawing Sheets

BALL FOR BALL-POINT PEN AND BALL-POINT PEN

TECHNICAL FIELD

The present invention relates to a spherical ball used for a tip portion of a ball-point pen and relates to a ball-point pen utilizing the ball.

BACKGROUND ART

Conventionally, in a tip portion of a ball-point pen, a ball for a ball-point pen is rotatably held by an edge portion which is formed by crimping the tip end portion inwards and by the ball seat portion of the tip main body. One part of the ball protrudes outside from the edge portion and the ball rotates in a ball-holding chamber formed by the edge portion and the ball seat portion to supply ink to the tip portion. As a ball for the ball-point pen, high abrasion resistance is required to the material for the ball and therefore super steel material is generally used.

As described above, the ball for a ball-point pen held in the ball-holding chamber supplies ink by rotating while the ball is contacting with the edge portion and the ball seat portion. Thus the ball is necessary to have enough abrasion resistance with respect to the edge portion and the ball seat portion. However, when the abrasion resistance of the ball is inadequate, abrasion easily occurs due to the contacting rotation of the ball with the edge portion and the ball seat portion and a smooth rotation is not attained frequently. As a result, a blur of a line occurs and the thickness of the ink is liable to change when the ball-point pen is used. This leads to a problem of reduction in writing performance. Therefore, conventionally in general, the super steel material whose hardness is extremely high is used as a ball for a ball-point pen. However, as the super steel material has a very high hardness in itself, its processing of the ball is very difficult, which leads to high in manufacturing cost and hours.

Also, a ball-point pen is required to have smoothness and consistent operation when the ball-point pen is used. Thus a lubricating ability is required of the ball in itself. However, for increasing the lubricating ability on the surface of the ball which is made of super steel material, it is necessary to improve the surface smoothness and the sphericity of the ball by grinding for a long working time, which results in more increasing manufacturing cost and time.

The object of the present invention is to provide a ball for a ball-point pen and a ball-point pen with the use of it, which are superior in easy manufacture and possesses a good abrasion resistance and a good lubricating ability. Disclosure of invention In accordance with a ball for a ball-point pen as set forth in claim 1 of the present invention, stainless steel is used for the material and the surface of the material is formed with a nitrosulphurized layer. According to the present invention, the spherical shape of the ball is easily attained, and the ball for a ball-point pen can be obtained which is superior in abrasion resistance and lubricating ability by utilizing the nitrosulphurized layer.

In accordance with a ball for a ball-point pen as set forth in claim 2, the nitrosulphurized layer has an iron nitride layer and an iron sulphide layer by means of reacting the iron on the surface of the stainless steel with nitrogen and sulfur. Thus, the iron nitride layer makes the ball attain abrasion resistance which is approximately equal to that of a super steel material, and the iron sulphide layer makes the ball have lubricating ability which is extremely satisfactory.

In accordance with a ball for a ball-point pen as set forth in claim 3, aluminum chrome molybdenum steel is used for the material and the surface of the material is formed with a nitrosulphurized layer. Therefore, the ball shape can be easily obtained and a ball for a ball-point pen can be obtained which is superior in abrasion resistance and lubricating ability due to the nitrosulphurized layer.

In accordance with a ball for a ball-point pen as set forth in claim 4, the nitrosulphurized layer has an iron nitride layer and an iron sulphide layer by means of reacting the iron on the surface of the aluminum chrome molybdenum steel with nitrogen and sulfur. Thus, the iron nitride layer makes the ball attain abrasion resistance which is approximately equal to that of super steel material, and the iron sulphide layer makes the ball have lubricating ability which is extremely satisfactory.

In accordance with a ball for a ball-point pen as set forth in claim 5, the aluminum chrome molybdenum steel is SACM 645 which contains chrome of 1.3–1.7%. The SACM 645 is easy to process into a spherical shape because its workability is superior before the nitrosulphurizing process is conducted, and after the nitrosulphurizing process, its hardness increases markedly to make the steel material superior in abrasion resistance and lubricating ability. The processing gives the ball superior quality for use as a ball for a ball-point pen.

In addition, in accordance with a ball-point pen utilizing such a ball as described in each of the claims above, writing performance is extremely satisfactory along with its durability.

PREFERRED EMBODIMENT

The embodiments of the present invention for a ball-point pen and a ball for a ball-point pen are described below with reference to the drawings.

Figure 1:
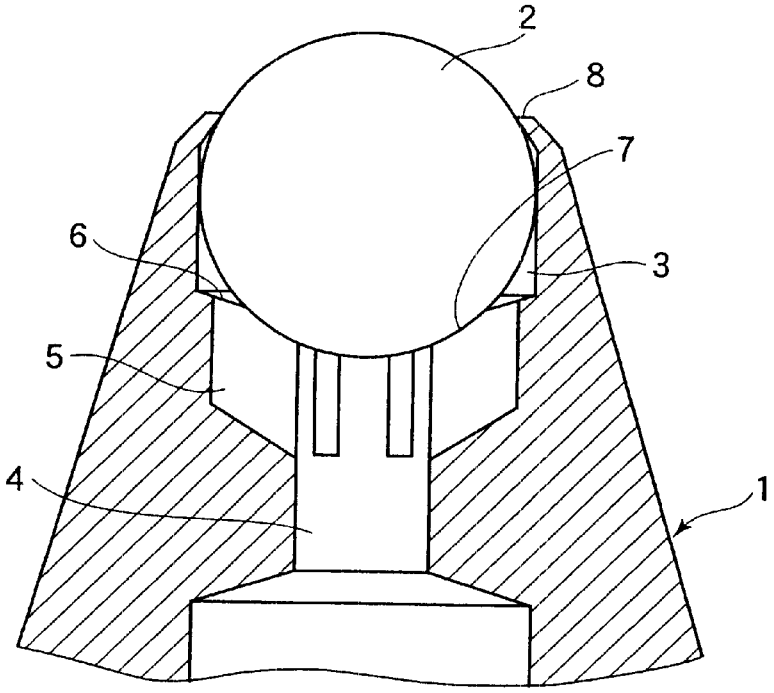
FIG. 1 is a cross-sectional view to show a tip portion of a ball-point pen with the use of a ball of the present invention.

FIG. 1 is a cross-sectional view which shows a tip portion of a ball-point pen with the use of the ball in the present invention.

In a tip portion 1, a ball-holding chamber 3 is formed for rotatably holding a ball 2 for a ball-point pen in the present invention. The ball-holding chamber 3 is formed by an edge portion 8 which is crimped inwards at the tip portion 1 together with a bottom portion 6 of the ball-holding chamber 3. The contacting portion with the ball 2 which is formed at the bottom portion 6 of the ball holding chamber 3 is formed like a sphere shape as a ball seat portion 7. The ball 2 is rotatably held between the edge portion 8 and the ball seat portion 7 with one portion of the ball 2 protruding outwardly from the edge portion 8. An ink passage hole 4 is provided in the bottom 6 of the ball- holding chamber 3 and radial grooves 5 are formed radially from this ink passage hole 4. Thus, while the ball 2 rotates in the ball- holding chamber 3 formed by the edge portion 8 and the ball seat portion 7, ink is supplied through the ink passage hole 4 to the ball protruding outwardly from the edge portion 8.

Next, an embodiment of a ball used as the ball 2, for a ball-point pen in the present invention is described in detail as follows.

Figure 2:
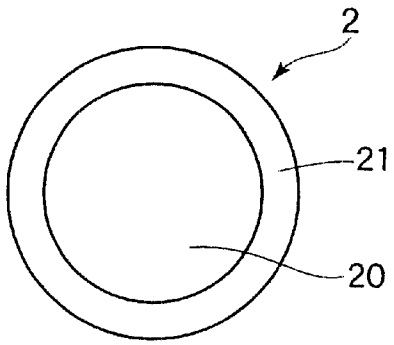
FIG. 2 is an explanatory view of the ball for the ball-point pen shown in FIG. 1.

A first embodiment of a ball 2 for a ball-point pen in the present invention, as shown in FIG. 2, is as follows, wherein the surface of a ball material 20 consisting of stainless steel is formed with a nitrosulphurized layer 21 on the surface of the ball material 20 by performing a nitrosulphurizing process. As for the ball material 20 consisting of stainless steel, a well-known steel material can be used, for example, austenitic stainless steels of the 304th class SUS, etc, martensitic stainless steel of the 403rd class SUS, etc, or ferritic stainless steel of the 430th class SUS, etc. The ball material 20 can be rounded and processed to a spherical shape after stainless steel of round bar is cut in a predetermined length, and therefore, the ball material 20 can be manufactured easily in comparison with the case of super steel material.

The ball 2 in the present invention is, at first, formed in a sphere shape of a dimension approximately the same as the finished dimension by using a ball material 20 consisting of stainless steel and by such a processing as described above, and then the nitrosulphurizing process is performed on the ball material 20 and nitrosulphurized layer 21 is formed on the surface of the ball material 20. As a method of the nitrosulphurizing process, nitriding gas $NH_3$ in which occurs a thermal dissociation of nitrogen and sulfurized gas $H_2S$ in which occurs a thermal dissociation of sulfur at around 500° C. are introduced into the retroaction furnace which contains many balls 2 consisting of the ball material 20. Then the inside of the retroaction furnace is heated to around 500° C. Thus a nitrosulphurized layer 21 is formed on the surface of the ball material by the reaction of nitrogen and sulfur at the nascency by thermal dissociation with the iron of the surface of the stainless steel.

By performing the nitrosulphurizing process described above, the composition of the surface of the ball material 20 made of stainless steel is reformed to a nitrosulphurized layer 21 of 10–20$\mu$m which consists of an iron sulphide layer and an iron nitride layer. Accordingly a ball for a ball-point pen of a dimension approximately the same as the ball material 20 can be manufactured. This nitrosulphurized layer 21 has an iron nitride ($Fe_{2-4}N$) layer which is produced by an iron (Fe) atom combining with a nitrogen atom (N) by heat treatment and therefore, the nitrosulphurized layer 21 can have hardness, that is, abrasion resistance equal to super steel material. In addition, the nitrosulphurized layer 21 has an iron sulphide (FeS, $FeS_2$ layer which is produced by an iron (Fe) atom combining with a sulfur atom (S) by heat treatment, and therefore, the lubricating ability is extremely satisfactory. That is, as a ball-point pen, a good writing performance can be obtained along with smoothness.

In the nitrosulphurizing process, the thickness of the nitrosulphurized layer can be made thicker by lengthening heating time. In addition, after performing the nitrosulphurizing process, the surface of the ball may be ground with a vibration barrel.

Next, in the second embodiment of a ball 2 for a ball-point pen of the present invention, aluminum chrome molybdenum steel (Japanese industrial standard SACM) is used as a ball material instead of stainless steel. That is, the nitrosulphurizing process is performed on the surface of a ball material made of aluminum chrome molybdenum steel to form a nitrosulphurized layer on the surface of the ball material.

In this embodiment of the present invention, Japanese industrial standard SACM 645 is employed as the aluminum chrome molybdenum steel. This SACM 645 is an alloy consisting of Fe which is the principal component and of a minute amount of Cr, Mo, Al, C, Si, and Mn, etc. Specifically, Cr of 1.3–1.7%, Mo of 0.15–0.30%, and Al of 0.7–1.2% are preferable. Cr and Mo can improve hardness and tensile-strength, and Al can improve malleability.

The ball in the present invention is, at first, formed into a sphere shape by using a ball material consisting of SACM 645 and then the nitrosulphurizing process is performed to form a nitrosulphurized layer on the surface of the ball material. A method of the nitrosulphurizing process is as follows, similarly as the case of stainless steel, wherein nitriding gas $NH_3$ and sulfurized gas $H_2S$ are introduced into the retroaction furnace which contains many balls 2 consisting of SACM 645. The nitrosulphurized layer 21 is formed on the surface of the ball material by reacting nitrogen and sulfur with the iron on the surface of SACM 645.

By performing the nitrosulphurizing process described above, the surface of the ball material consisting of SACM 645 is formed with the nitrosulphurized layer of 10–20$\mu$m which consists of the iron sulphide layer and the iron nitride layer. Thus a ball for a ball-point pen is manufactured.

As described above, in the ball utilizing the material made of SACM 645, the nitrosulphurized layer 21 has an iron nitride ($Fe_{2-4}N$) layer which is produced by an iron (Fe) atom combining with a nitrogen atom (N) by heat treatment and thus hardness and abrasion resistance equal to super steel material can be obtained. In addition, the nitrosulphurized layer 21 has an iron sulphide (FeS, $FeS_2$) layer which is produced by an iron (Fe) atom combining with a sulfur atom (S) by heat treatment, which results in satisfactory smoothness and good writing performance.

Figure 3:
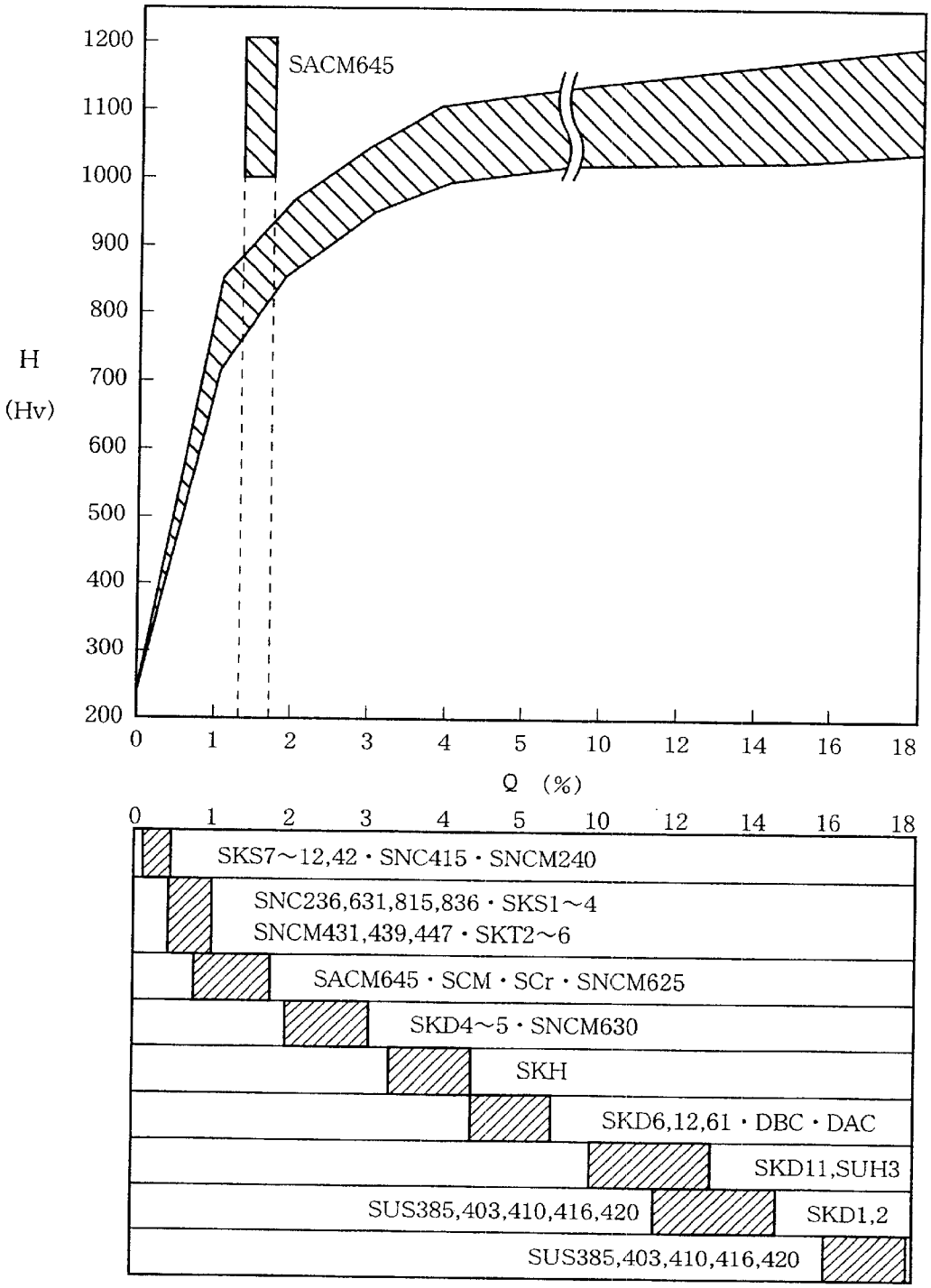
FIG. 3 is a graphical chart which shows a relationship with various steel materials and a surface hardness after the nitrosulphurizing process and the chrome contents in the various steel materials.

FIG. 3 is a graphical chart which shows the relationship with various steel materials and surface hardness after the nitrosulphurizing process, and Cr (chrome) content in the various steel materials. As shown in FIG. 3, the hardness H of the steel material which is nitrosulphurized becomes higher according to the increase in the Cr content Q until the Cr content in the steel material reaches around 4%. However, the hardness of the steel material hardly increases when the Cr content exceeds about 4%. The reason is that when Cr is heated strongly, the Cr directly reacts with Nitrogen but when there is too much Cr content, the reaction will be saturated. In addition, the steel material including the Cr content of more than 4% has already had a greater hardness before performing the nitrosulphurizing process but has an inferior workability.

Aluminum chrome molybdenum steel (SACM) as a material for the ball for a ball-point pen in the present embodiment contains about 0.8–1.7% Cr, and especially SACM 645 contains Cr of 1.3–1.7%. The point especially paid attention to is, as shown in FIG. 3, that the surface hardness of SACM 645 after having nitrosulphurized is nearly the same level or greater (Hv1000 to 1200) than the surface hardness of the steel material which contained Cr more than 4% after having nitrosulphurized. That is, SACM 645 is superior in workability and is easy to process into a ball shape before the nitrosulphurizing process. On the other hand, after the nitrosulphurizing process, the hardness of SACM 645 increases markedly and is reformed to a steel material which is superior in abrasion resistance and sliding ability, that results in a very superior ball as a ball for a ball-point pen.

In addition, by nitrosulphurizing of SACM, the nitrosulphurized layer formed on the surface improves the corrosion resistance more than that of the original material.

Accordingly, even if the ball is used as a ball for an aqueous ball-point pen, rust does not occur.

INDUSTRIAL APPLICABILITY

As described above, aluminum chrome molybdenum steel (SACM) which is material of a ball for a ball-point pen in the present invention is superior in workability and besides the nitrosulphurized layer can be formed in a short time. Therefore, a ball which is superior in abrasion resistance and lubricating ability can be provided with low cost. The sliding ability while the ball rotates in contact with the ball seat portion becomes extremely satisfactory, and the writing performance of the ball-point pen is improved.

In a nitrosulphurizing process, a longer heating time can make the nitrosulphurized layer thicker. In addition, after the nitrosulphurizing process, the surface may be ground with a vibration barrel.

What is claimed is:

1. In a spherical ball used in a tip portion of a ball-point pen, the ball is made of a material of stainless steel whose surface is formed of a nitrosulphurized layer.

2. A ball for a ball-point pen as set forth in claim 1, wherein the nitrosulphurized layer includes an iron nitride layer and an iron sulphide layer provided by reacting the iron of the surface of the stainless steel with nitrogen and sulfur.

3. A ball-point pen having the ball as set forth in claim 2 in the tip portion of the ball-point pen.

4. A ball-point pen having the ball as set forth in claim 1 in the tip portion of the ball-point pen.

5. In a spherical ball used in a tip portion of a ball-point pen, the ball is made of a material of aluminum chrome molybdenum steel whose surface is formed of a nitrosulphurized layer.

6. A ball for a ball-point pen as set forth in claim 5, wherein the nitrosulphurized layer includes an iron nitride layer and an iron sulphide layer provided by reacting the iron of the surface of the aluminum chrome molybdenum steel with nitrogen and sulfur.

7. A ball for a ball-point pen as set forth in claim 6, wherein the aluminum chrome molybdenum steel is SACM 645 containing chrome of 1.3–1.7%.

8. A ball-point pen having the ball as set forth in claim 6 in the tip portion of the ball-point pen.

9. A ball-point pen having the ball as set forth in claim 5 in the tip portion of the ball-point pen.

* * * * *